United States Patent [19]

Hays

[11] Patent Number: 5,010,367

[45] Date of Patent: Apr. 23, 1991

[54] DUAL AC DEVELOPMENT SYSTEM FOR CONTROLLING THE SPACING OF A TONER CLOUD

[75] Inventor: Dan A. Hays, Fairport, N.Y.

[73] Assignee: Xerox Corporation, Stamford, Conn.

[21] Appl. No.: 448,407

[22] Filed: Dec. 11, 1989

[51] Int. Cl.[5] ..... G03G 15/08

[52] U.S. Cl. ..... 355/247; 118/654; 355/328

[58] Field of Search ..... 355/326, 328, 259, 265, 355/245, 247, 248, 249; 118/647, 651, 653, 654

[56] References Cited

U.S. PATENT DOCUMENTS

| | | | |
|---|---|---|---|
| 3,457,900 | 7/1969 | Drexler | 118/637 |
| 3,900,001 | 8/1975 | Fraser et al. | 118/637 |
| 4,078,929 | 3/1978 | Gundlach | 96/1.2 |
| 4,308,821 | 1/1982 | Matsumoto et al. | 118/645 |
| 4,431,296 | 2/1984 | Haneda et al. | 355/249 |
| 4,478,505 | 10/1984 | Tashiro | 355/245 |
| 4,486,089 | 12/1984 | Itaya et al. | 355/251 |
| 4,527,884 | 7/1985 | Nusser | 355/249 |
| 4,568,955 | 2/1986 | Hosoya et al. | 346/153.1 |
| 4,656,427 | 4/1987 | Dauphinee | 324/444 |
| 4,810,604 | 3/1989 | Schmidlin | 430/42 |
| 4,833,504 | 5/1989 | Parker et al. | 355/326 |
| 4,868,600 | 9/1989 | Hays et al. | 355/259 |
| 4,876,573 | 10/1989 | Kamimura | 355/247 |

FOREIGN PATENT DOCUMENTS

| | | | |
|---|---|---|---|
| 0273562 | 12/1986 | Japan | 355/247 |
| 62-70881 | 4/1987 | Japan . | |

*Primary Examiner*—A. T. Grimley
*Assistant Examiner*—William J. Royer

[57] ABSTRACT

A scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

32 Claims, 4 Drawing Sheets

DUAL AC DEVELOPMENT SYSTEM FOR CONTROLLING THE SPACING OF A TONER CLOUD

BACKGROUND OF THE INVENTION

This invention relates generally to the rendering of latent electrostatic images visible using multiple colors of dry toner or developer and more particularly to a development system that does not scavenge or interact with a previously toned image.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is charged, typically to 900 volts. It is exposed imagewise, such that one image corresponding to charged image areas (which are subsequently developed by charged-area development, i.e. CAD) stays at the full photoreceptor potential ($V_{cad}$ or $V_{ddp}$). The other image is exposed to discharge the photoreceptor to its residual potential, i.e. $V_{dad}$ or $V_c$ (typically 100 volts) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 volts) and is referred to as $V_{white}$ or $V_w$. The CAD developer is typically biased about 100 volts closer to $V_{cad}$ than $V_{white}$ (about 600 volts), and the DAD developer system is biased about 100 volts closer to $V_{dad}$ than $V_{white}$ (about 400 volts).

The viability of printing system concepts such as tri-level, highlight color xerography requires development systems that do not scavenge or interact with a previously toned image. Since commercial development systems such as conventional magnetic brush development and jumping single component development interact with the image receiver, a previously toned image will be scavenged by subsequent development. Since the present commercial development systems are highly interactive with the image bearing member, there is a need for scavengeless or non-interactive development systems.

It is known in the art to alter the magnetic properties of the magnetic brush in the second housing in order to obviate the foregoing problem. For example, there is disclosed in U.S. Pat. No. 4,308,821 granted on Jan. 5, 1982 to Matsumoto, et al, an electrophotographic development method and apparatus using two magnetic brushes for developing two-color images which allegedly do not disturb or destroy a first developed image during a second development process. This is because a second magnetic brush contacts the surface of a latent electrostatic image bearing member more lightly than a first magnetic brush and the toner scraping force of the second magnetic brush is reduced in comparison with that of the first magnetic brush by setting the magnetic flux density on a second non-magnetic sleeve with an internally disposed magnet smaller than the magnetic flux density on a first magnetic sleeve, or by adjusting the distance between the second non-magnetic sleeve and the surface of the latent electrostatic image bearing members. Further, by employing toners with different quantity of electric charge, high quality two-color images are obtained.

U.S. Pat. No. 3,457,900 discloses the use of a single magnetic brush for feeding developer into a cavity formed by the brush and an electrostatic image bearing surface faster than it is discharged thereby creating a roll-back of developer which is effective in toning an image. The magnetic brush is adapted to feed faster than it discharges by placement of strong magnets in a feed portion of the brush and weak magnets in a discharge portion of the brush.

U.S. Pat. No. 3,900,001 discloses an electrostatographic developing apparatus utilized in connection with the development of conventional xerographic images. Developer material is applied to a developer receiving surface in conformity with an electrostatic charge pattern wherein the developer is transported from the developer supply to a development zone while maintained in a magnetic brush configuration and thereafter, transported through the development zone magnetically unconstrained but in contact with the developer receiving surface.

As disclosed in U.S. Pat. No. 4,486,089 granted on Dec. 4, 1984 to Itaya, et. al. a magnetic brush developing apparatus for a xerographic copying machine or electrostatic recording machine has a sleeve in which a plurality of magnetic pieces are arranged in alternating polarity. Each piece has a shape which produces two or more magnetic peaks. The sleeve and the magnets are rotated in opposite directions. As a result of the above, it is alleged that a soft developer body is obtained, and density unevenness or stripping of the image is avoided.

U.S. Pat. No. 4,833,504 granted on May 23, 1989 to Parker et al discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate to a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complimentary half of a tri-level latent image while at the same time allowing the already developed first half to pass through the second housing with minimum image disturbance.

U.S. Pat. No. 4,810,604 granted to Fred W. Schmidlin on Mar. 7, 1989 discloses a printing apparatus wherein highlight color images are formed without scavenging and re-development of a first developed image. A first image is formed in accordance with conventional (i.e. total voltage range available) electrostatic image forming techniques. A successive image is formed on the copy substrate containing the first image subsequent to first image transfer, either before or after fusing, by utilization of direct electrostatic printing. Thus, the '604 patent solves the problem of developer interaction with previously recorded images by forming a second image on the copy substrate instead of on the charge retentive surface on which the first image was formed.

U.S. Pat. No. 4,478,505 issued on Oct. 23, 1984 relates to developing apparatus for improved charging of flying toner. The apparatus disclosed therein comprises a conveyor for conveying developer particles from developer supplying means to a photoconductive body positioned to define a gap therebetween. A developer supplying passage for conveying developer particles is provided between the developer supplying means and the gap. The developer supplying passage is defined by the conveyor and an electrode plate provided with a predetermined interval with the conveyor. An alternating electric field is applied to the developer supplying passage by an A.C. power source to reciprocate the developer particles between the conveyor and the electrode plate thereby sufficiently and uniformly charging the developer particles by friction. In the embodiment disclosed in FIG. 6 of the '505 patent, a grid is disposed in a space between the photosensitive layer and a donor member.

U.S. Pat. No. 4,568,955 issued on Feb. 4, 1986 to Hosoya et al discloses a recording apparatus wherein a visible image based on image information is formed on an ordinary sheet by a developer. The recording apparatus comprises a developing roller spaced at a predetermined distance from and facing the ordinary sheet and carrying the developer thereon, a recording electrode and a signal source connected thereto, for propelling the developer on the developing roller to the ordinary sheet by generating an electric field between the ordinary sheet and the developing roller according to the image information, a plurality of mutually insulated electrodes provided on the developing roller and extending therefrom in one direction, an A.C. and a D.C. source are connected to the electrodes, for generating an alternating electric field between adjacent ones of the electrodes to cause oscillations of the developer found between the adjacent electrodes along electric lines of force therebetween to thereby liberate the developer from the developing roller.

U.S. Pat. No. 4,656,427 granted to Hosaka et al on Mar. 31, 1987 discloses a method and apparatus wherein a layer of developer which is a mixture of insulative, magnetic particles and insulative toner particles is carried on the surface of a developer sleeve forming part of a magnetic brush. A latent image bearing member carrying an image to be developed is moved relative to the magnetic brush. The brush is spaced from the image bearing member and an AC field is formed across the space to effect toner transfer to the image and nonimage areas and to effect a back transfer of excessive toner.

Japanese publication No. 62-70881 discloses a toner separating means using a plurality of electrically biased grid wires disposed intermediate a magnet brush developer roll and an imaging surface. The two-component developer is triboelectrified and magnetic carrier is removed from the outer periphery of a sleeve by the action of the north and south poles of the magnetic poles of the magnetic brush.

U.S. Pat. No. 4,868,600 granted to Hays et al on Sept. 19, 1989 and assigned to the same assignee as the instant application discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. patent application Ser. No. 424,482 filed on Oct. 20, 1989 and assigned to the same assignee as the instant application discloses a scavengeless development system for use in highlight color imaging. AC biased electrodes positioned in close proximity to a magnetic brush structure carrying a two-component developer cause a controlled cloud of toner to be generated which non-interactively develops an electrostatic image. The two-component developer includes mixture of carrier beads and toner particles. By making the two-component developer magnetically tractable, the developer is transported to the development zone as in conventional magnetic brush development where the development roll or shell of the magnetic brush structure rotates about stationary magnets positioned inside the shell.

Some highlight and process color electronic printing concepts are based on multiple xerographic development of an electrostatic latent image on either a photoreceptor or electroreceptor. These printing system concepts can be enabled by development system designs that do not scavenge/interact with a previously toned image or cause cross contamination of the development systems. Since the present commercial two component development systems such as magnetic brush development and single component systems such as jumping interact with the image bearing member, there is a need to identify scavengeless or non-interactive development systems. Recent developments which address this need include powder cloud development systems based on AC fringe electric field toner detachment from a toned donor roll. The AC fringe electric field is provided by self-spaced AC based electrode structures such as wires positioned within the development nip. This configuration is incorporated in a single component development system ('600 patent mentioned above) and a scavengeless hybrid system the '482 application mentioned above in which the toned donor is supplied by two component magnetic brush development.

BRIEF SUMMARY OF THE INVENTION

In accordance with the present invention, a dual AC voltage xerographic development system is provided in which one AC voltage applied to electrodes near a toned donor provide an AC fringe electric field which causes toner detachment and generation of a toner cloud in a gap between the toned donor and image receiver, whereas another AC voltage provides an AC electric field across the gap between the electrode/donor and image receiver to control the proximity of the toner cloud to the receiver. In one embodiment of the invention one AC/DC voltage is applied between the donor substrate and wires in self-spaced contact with the toned donor roll and another AC/DC voltage is applied between the donor roll/wire electrode assembly and ground. The dual AC voltage configuration enables optimum system performance since the AC/DC voltage levels between the donor and wire electrodes can be set to optimum values for toner detachment and formation of the toner cloud whereas the AC/DC voltage levels between the donor and receiver can be independently set at optimum values for controlling the position of the toner cloud within the development gap. The latter AC/DC voltage which provides control of the toner cloud in the development gap results in better development of line images and minimization of toner/-receiver interaction.

DETAILED DESCRIPTION OF THE PREFERRED EMBODIMENT OF THE INVENTION

Figure 1A:
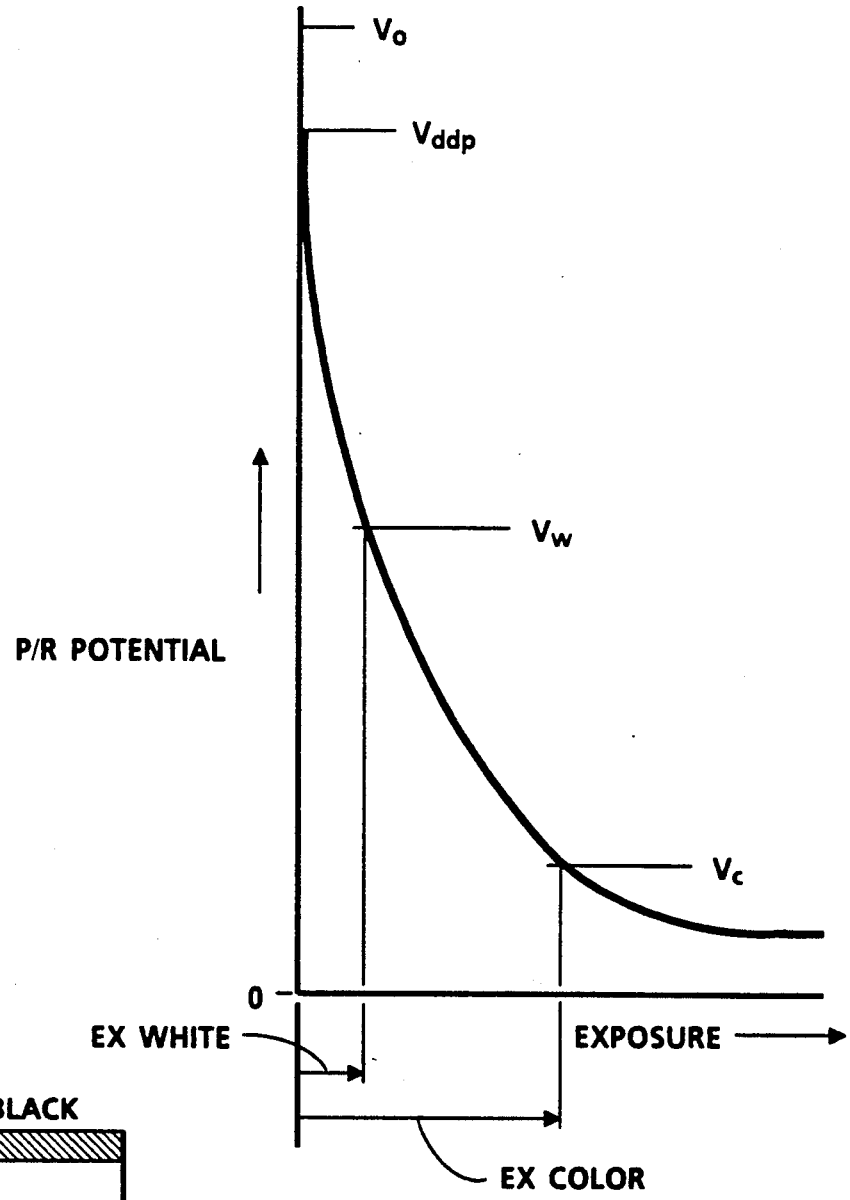
FIG. 1*a* is a plot of photoreceptor potential versus exposure illustrating a tri-level electrostatic latent image.
Figure 1B:
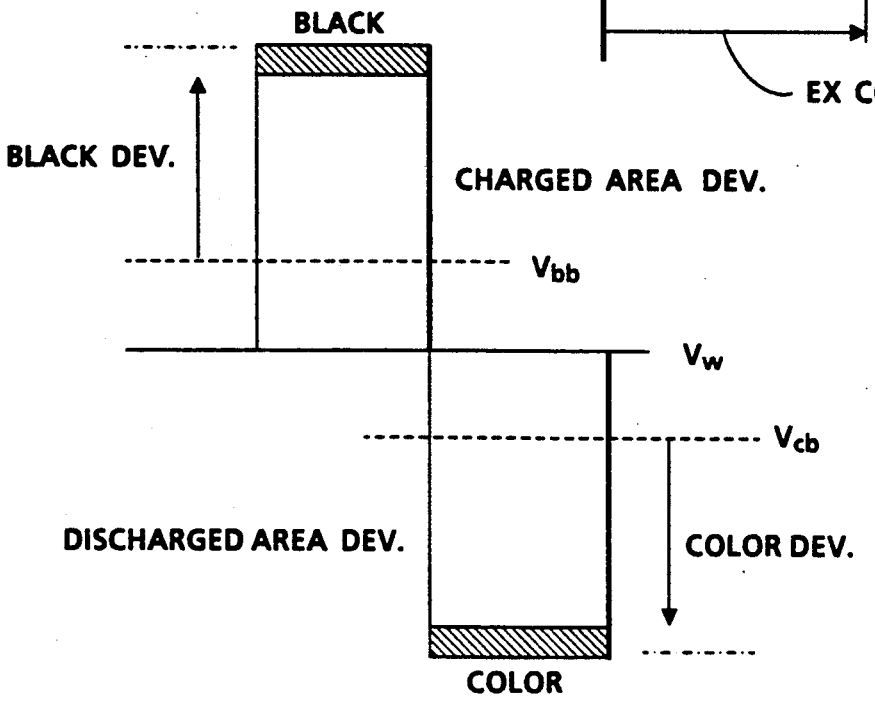
FIG. 1*b* is a plot of photoreceptor potential illustrating singlepass, highlight color latent image characteristics.

For a better understanding of the concept of tri-level, highlight color imaging, a description thereof will now be made with reference to FIGS. 1*a* and 1*b*. FIG. 1*a* illustrates the tri-level electrostatic latent image in more detail. Here $V_0$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved when passing the photoreceptor through two developer housings in tandem or in a single pass by electrically biasing the housings to voltages which are offset from the background voltage $V_w$, the direction of offset depending on the polarity or sign of toner in the housing. One housing (for the sake of illustration, the second) contains developer with black toner having triboelectric properties such that the toner is driven to the most highly charged ($V_{ddp}$) areas of the latent image by the electrostatic field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electrostatic field existing between the photoreceptor and the development rolls in the first housing at bias voltage $V_{cb}$ (V color bias).

Figure 2:
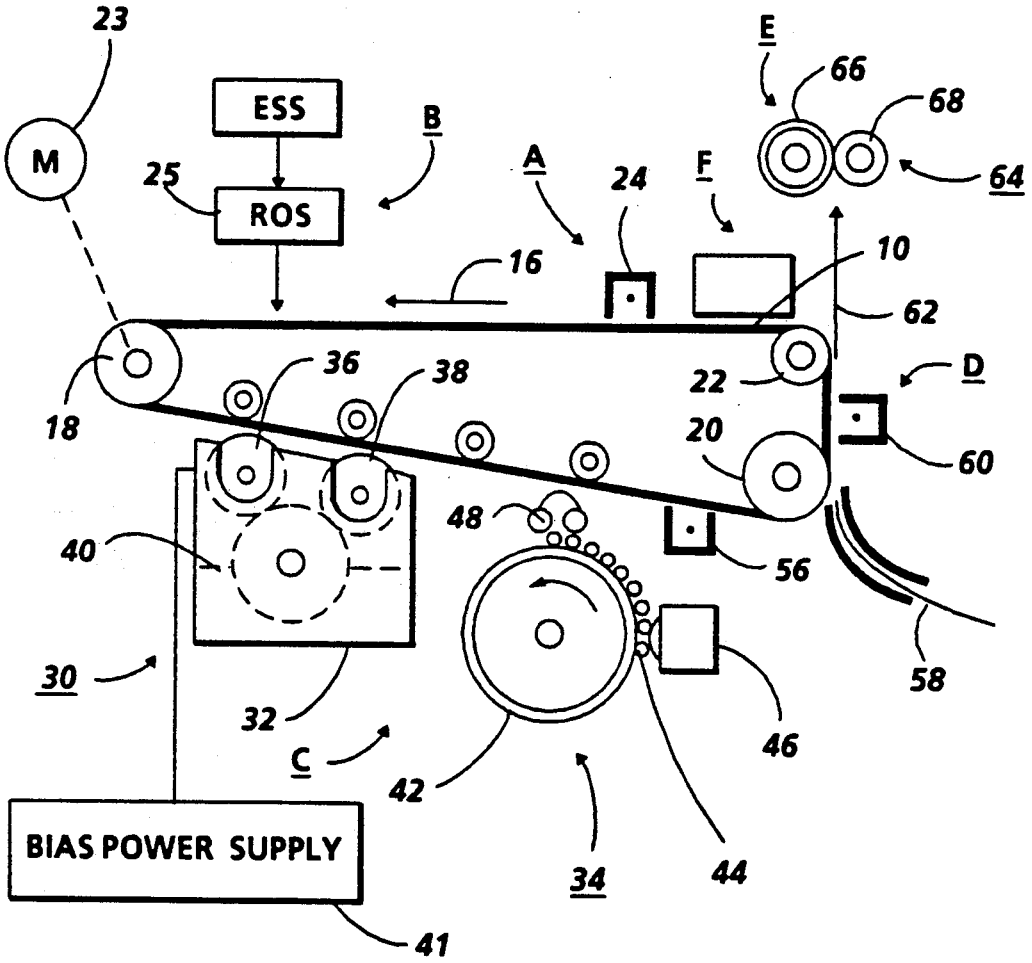
FIG. 2 is schematic illustration of a printing apparatus incorporating the inventive features of the invention.

As shown in FIG. 2, a highlight color printing machine in which the invention may be utilized comprises a charge retentive member in the form of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device. An electronic subsystem (ESS) 27 provides for control of the ROS as well as other subassemblies of the machine.

The photoreceptor, which is initially charged to a voltage $V_0$, undergoes dark decay to a level $V_{ddp}$ equal to about −900 volts. When exposed at the exposure station B it is discharged to $V_c$ equal to about −100 volts which is near zero or ground potential in the highlight (i.e. color other than black) color parts of the image. See FIG. 1*a*. The photoreceptor is also discharged to $V_w$ equal to approximately −500 volts imagewise in the background (white) image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 36 and 38. The rollers advance developer material 40 into contact with the latent images on the charge retentive surface which are at the voltage level $V_c$. The developer material 40 by way of example contains color toner and magnetic carrier beads. Appropriate electrical biasing of the developer housing is accomplished via power supply 41 electrically connected to developer apparatus 32. A DC bias of approximately −400 volts is applied to the rollers 36 and 38 via the power supply 41. With the foregoing bias voltage applied and the color toner suitably charged, discharged area development (DAD) with colored toner is effected.

The second developer apparatus 34 comprises a donor structure in the form of a roller 42. The donor structure 42 conveys developer 44, which in this case is a single component developer comprising black toner deposited thereon via a combination metering and charging device 46, to an area adjacent an electrode structure. The toner metering and charging can also be provided by a two component developer system such as a magnetic brush development structure. The donor structure can be rotated in either the 'with' or 'against' direction vis-a-vis the direction of motion of the charge retentive surface. The donor roller 42 is preferably coated with TEFLON-S (trademark of E. I. DuPont De Nemours) or anodized aluminum.

Figure 3:
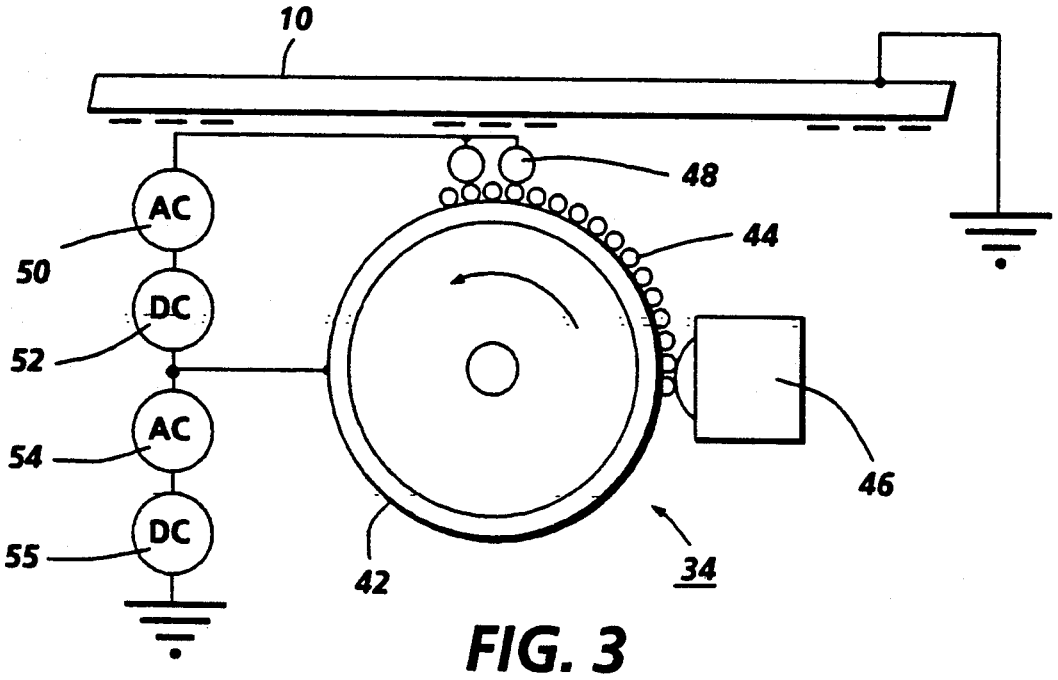
FIG. 3 is a fragmentary schematic view of a development structure according to the invention.

The developer apparatus 34 further comprises an electrode structure 48 which is disposed in the space between the charge retentive surface 10 and the donor structure 42. The electrode structure is comprised of one or more thin (i.e. 50 to 100 μm diameter) tungsten wires which are positioned closely adjacent the donor structure 42. The distance between the wires and the donor is approximately 25 μm or the thickness of the toner layer on the donor roll. Thus, the wires are self-spaced from the donor structure by the thickness of the toner on the donor structure. For a more detailed description of the foregoing, reference may be had to U.S. Pat. No. 4,868,600 granted to Hays et al on Sept. 19, 1989. As illustrated in FIG. 3, an alternating electrical bias is applied to the electrode structure 48 via an AC voltage source 50. The applied AC establishes an alternating electrostatic field between the wires and the donor structure which is effective in detaching toner from the surface of the donor structure and forming a toner cloud intermediate the donor structure 42 and the charge retentive surface. The magnitude of the AC voltage is relatively low and is in the order of 200 to 300 volts peak at a frequency of about 4 kHz up to 10 kHz. A DC bias supply 52 applies approximately 0 to 50 volts on the wires 48 relative to the donor structure 42. At a spacing of approximately 25 μm between the electrode and donor structures an applied voltage of 200 to 300 volts produces a relatively large electrostatic field without risk of air breakdown. The use of a dielectric coating on either of the structures helps to prevent shorting of the applied AC voltage. The field strength produced is on the order of 8 to 16 volts/μm.

Once formed, the toner cloud's proximity to the image receiving surface is controlled by the application of an AC/DC bias voltage applied between the donor roll/wire electrode assembly and ground via AC source 54 and DC source 55. With an AC bias of approximately 270 volts applied to the wires as noted above, an AC bias at a frequency of 4 to 10 kHz is applied via the source 54. Simultaneously, a DC bias of approximately 600 volts is applied via the source 55 for establishing a development field between the donor and the image receiver such that charged area development (CAD) is effected.

An understanding of the advantages of the dual AC voltage development system of the present invention may be had from a review and comparison of the characteristics of jumping development and standard (i.e. toner cloud generation without a separate cloud control) scavengeless development. For jumping development, a peak AC voltage of typically 1000 volts at 1 to 4 kHz is applied across a 200 μm gap between the image receiver and donor roll toned with a single component development system. The maximum peak electric field is limited by air breakdown to ~6 V/μm. A threshold field of ~3 V/μm is required to detach the toner from the donor and form a toner cloud by projection (jumping) across the gap so that the toner can come into contact with the electrostatic image. The toner cloud formation requires a minimum of approximately 30 AC cycles since toner detachment from the donor depends on a cascade collisional process. The high peak electric field is necessary to detach the toner from the donor and project it across the gap to the image receiver. The kinetic energy of the toner impinging on the receiver is sufficient to scavenge and contaminate a previously toned colored image. The narrow latitude between the peak electric field for jumping and air breakdown requires a tight tolerance on the gap setting. Furthermore, if the solid area image potential is too high, the developability decreases since the forward biased electric field removes toner from the cloud which is required for the cascade collisional release of toner from the donor roll.

For a scavengeless system, AC fringe electric fields supplied by AC biased electrodes in close proximity with a toned donor enable non-interactive development since the toner in the cloud formed near the electrodes is not projected against the image with high kinetic energy. A peak AC voltage of typically 300 volts at a frequency of 4 to 6 kHz is applied between the self-spaced wires (typically 70 μm in diameter) and toned donor roll. A threshold voltage of ~150 volts is required to detach the toner from the donor. The maximum peak voltage is limited to ~400 volts by dielectric breakdown of the donor roll coating. Since the spacing between the wires and electrode structure is set by the toner layer thickness (~25 μm), the peak electric field for toner detachment can be as high as 16 V/μm. Considering the width of the high field region and a typical donor speed of 25 to 75 cm/s, a toner particle is subjected to about 5 AC cycles.

The high AC electric field is able to detach the toner to form a cloud near the wires. Since the toner cloud is spaced from the image receiver, toner does not impinge on the receiver and scavenge previously deposited color toner. However, if the toner cloud is spaced too far away, the development of lines will be narrowed since the fringe fields at the edges of the lines do not reach into the toner cloud. To obtain line development fidelity, it is important to bring the toner cloud as close as possible to the image receiver without a strong scavenging interaction (for situations where there is a previously toned image). To accomplish this, one could either reduce the gap or increase the cloud height. The gap reduction approach has limitations since present manufacturing and machine setup tolerances require gaps >200 μm. In connection with increasing the cloud height, it is noted that if the height of the toner cloud is proportional to the amplitude of toner particle motion due to an applied AC electric field, one expects the height to be proportional to the toner charge-to-mass ratio and peak electric field and inversely proportional to the frequency squared. Since the ranges of the toner charge and peak electric field are limited, a reduction in the frequency is an effective way of increasing the cloud height. However, lower frequencies reduce the developability since toner is subjected to fewer AC cycles which decreases the amount of toner in the cloud.

To control the developability of lines and the degree of interaction between the toner and receiver, an independent method for positioning the toner cloud relative to the receiver is herein contemplated. In accordance with the present invention, the combination of an AC voltage on the donor roll with an AC voltage between the wires (or other fringe electric field structures) and donor roll enables efficient detachment of toner from the donor to form a toner cloud and positioning of one end of the cloud in close proximity to the image receiver for optimum development of lines and solid areas without scavenging a previously toned image. The optimum AC frequencies, amplitudes and phase relationship will depend on the toner material, donor coating and gap. (An out-of-phase relationship decreases the AC electric field between the wires and receiver whereas an in-phase relationship will increase the AC field). The optimum DC voltage between the wire and donor should be between 0 and the surface potential of the toned donor which is typically 25 to 50 volts for positively charged toner. The optimum DC voltage between the donor and ground is set by the requirement to minimize background and maximize image density. Although separate AC/DC voltage supplies are illustrated in FIG. 3, only one AC and one DC power supply might be sufficient for some optimizations.

By controlling the height of the toner cloud with the AC voltage between the receiver and donor/electrode assembly, one can vary the range of spatial frequencies in the electrostatic image that are developed. For multiple colored development of lines, the toner cloud height for each colored development unit can be adjusted so that each color falls on top of the other even though the toned electrostatic image changes with each development. On the other hand, a color surround to an image can be made by appropriate adjustment of the toner cloud height for each colored development unit.

A sheet of support material 58 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing 82 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

The dual AC voltage invention disclosed was evaluated utilizing test equipment operating in a DAD mode at a process speed of 4.7 ips with a $V_{DDP}$ of −450 volts and maximum development potential of 350 volts. The second AC voltage was derived from a single square wave generator (500 volts peak) by using a resistor dividing network. The AC between the wires and donor was kept constant at 270 volts peak as the donor AC was varied. Since the development curves are strongly dependent on the AC voltages, sets of copies were obtained with different DC biases applied to the donor/wires assembly for each donor AC voltage setting.

Figure 4:
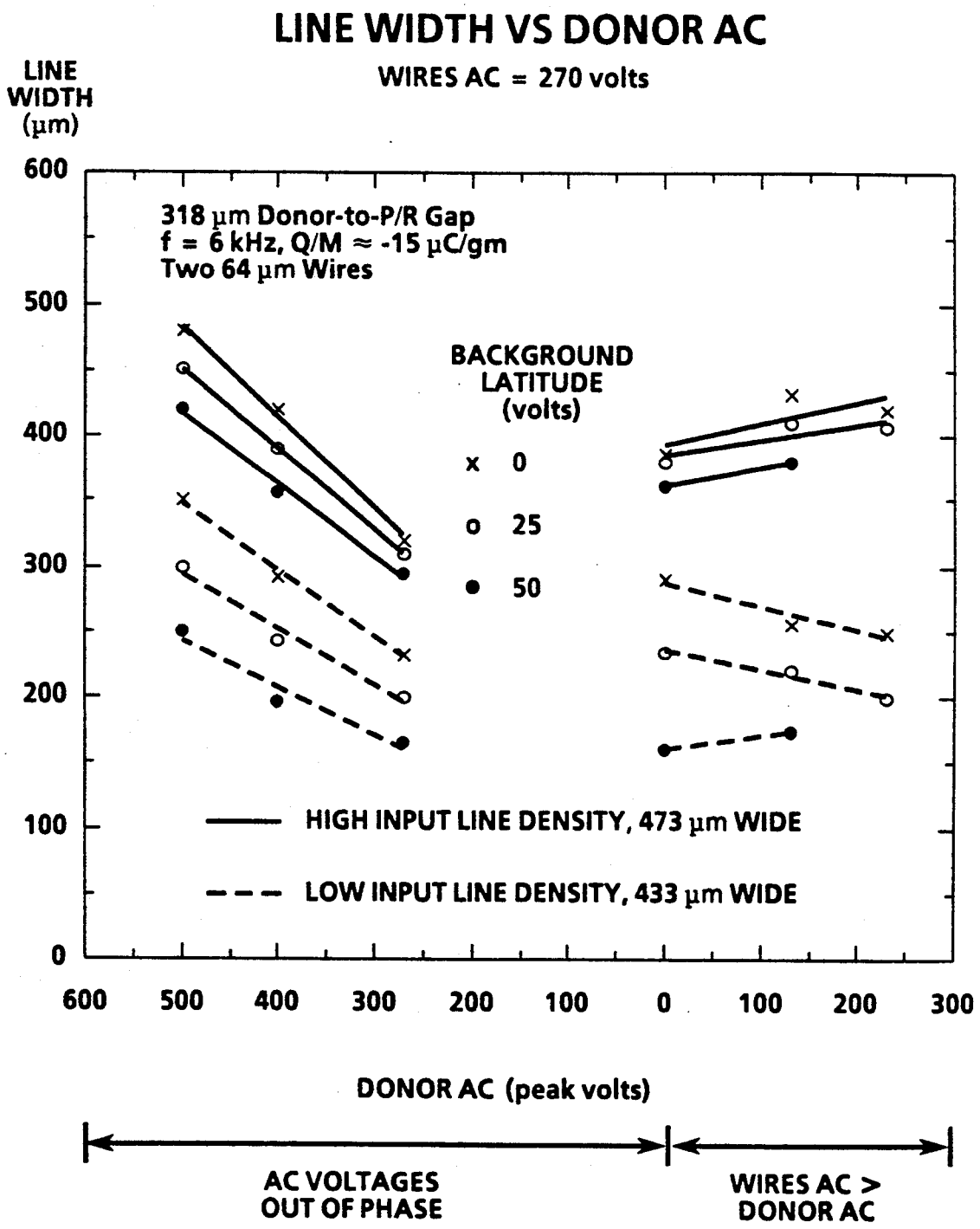
FIG. 4 is a plot of line width versus AC voltage bias applied to a donor roll.

Measurements of the line widths and peak optical densities of copies made with a test target were obtained on a Zeiss microdensitometer. Data for line widths versus donor AC voltage are depicted in FIG. 4. Data for a high input density line of width 473 μm are indicated by the solid lines. A low input density line of width 433 μm is denoted by the dashed lines. For each set of input lines, the upper data represents the line width obtained with 0 volts of background latitude. The middle and lower lines represent 25 and 50 volts of background latitude, respectively. The standard scavengeless development operating point corresponds to 0 donor AC volts. For an increasing donor AC voltage for which the AC is in phase with the wires AC (right hand side of FIG. 4), the line width is not strongly dependent on the donor AC. But for increasing donor AC when the AC is out of phase with the wires (left hand side of FIG. 1), the dependence of the line width on the donor AC is much greater. For a donor AC of 500 volts, the line width of the high and low density lines are significantly greater than the standard case. Extrapolation of the present curves to a higher donor AC implies further line width improvement, particularly for the low density line. The maximum donor AC will be limited by air breakdown. It is clear from FIG. 4 that the dual AC voltage condition of the donor AC being out of phase with the wires AC provides improved development of lines.

Figure 5:
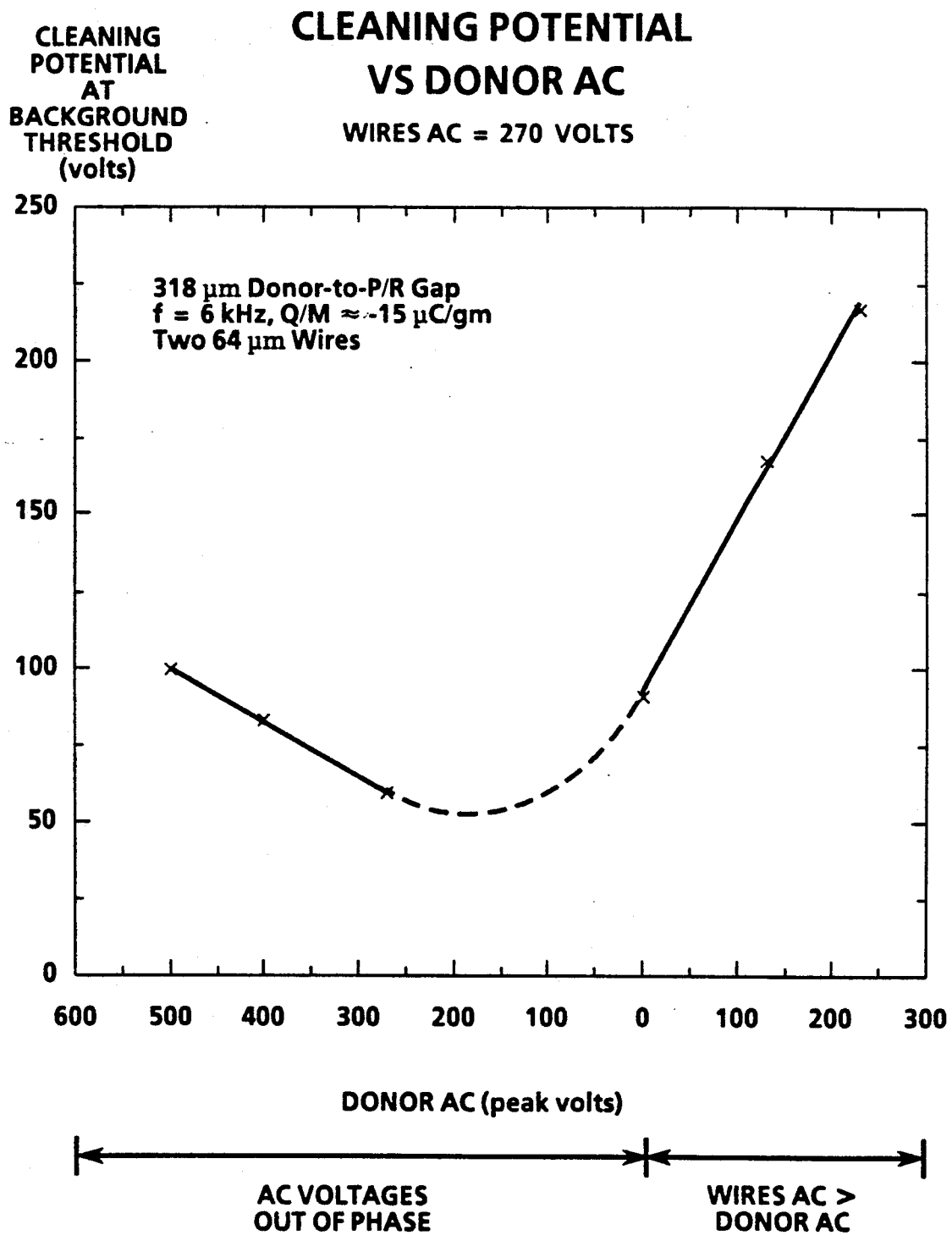
FIG. 5 is a plot of cleaning potential versus donor AC bias.

The cleaning potential at background threshold depends on the donor AC voltage as shown in FIG. 5. When the wires AC is in phase with the donor AC, a much higher cleaning potential is required to suppress the toner space charge electric field. When the donor AC is out of phase with the wires AC, the dependence of cleaning potential on donor AC is less since the electric field above the donor near the wires is lower.

What is claimed is:

1. Apparatus for forming images on an image receiving surface with developer, said apparatus comprising:
   - a supply of developer;
   - means for transporting developer from said supply to an area adjacent said image receiving surface;
   - means for forming transported developer into a cloud of marking particles;
   - means for controlling the spacing of said marking particle cloud relative to said image receiver without interacting with said image receiving surface; and
   - means for establishing a development field between said transporting means and said image receiving surface for causing an image on said image receiving surface to be developed with marking particles.

2. Apparatus according to claim 1 wherein said means for controlling the spacing of said marking particle cloud comprises an AC bias voltage applied between said means for transporting developer and said image receiving surface.

3. Apparatus according to claim 2 wherein said means for forming transported developer into a cloud is disposed between said transporting means and said image receiving surface.

4. Apparatus according to claim 3 wherein said means for forming transported developer into a cloud comprises an electrode structure.

5. Apparatus according to claim 3 wherein said means for forming transported developer into a cloud further comprises an AC bias voltage applied to said electrode structure.

6. Apparatus according to claim 5 wherein said AC bias voltages have a different magnitude.

7. Apparatus according to claim 6 wherein the AC bias voltage applied between said image receiving surface and said transporting means is out of phase with the AC bias voltage applied to said electrode structure.

8. Apparatus according to claim 7 including means for forming tri-level images on said image receiving surface.

9. Apparatus according to claim 8 including means for forming said tri-level images in a single pass of said images receiving surface past process stations used in forming said images.

10. Apparatus according to claim 9 wherein said supply of developer comprises single component developer.

11. Apparatus according to claim 10 wherein said transporting means comprises a donor roll.

12. Apparatus according to claim 11 wherein said supply of developer, said transporting means, said means for forming and said means for controlling comprise a first developer apparatus and wherein said apparatus for forming images further includes a second developer apparatus including another supply of developer.

13. Apparatus according to claim 12 wherein said tri-level images comprise two image areas and a background area.

14. Apparatus according to claim 13 wherein said developer supply is utilized for developing one of said two images and said another of said developer supplies is utilized for developing the other of said two images.

15. Apparatus according to claim 9 wherein said supply of developer comprises two component developer.

16. Apparatus according to claim 2 wherein said means for forming transported developer, into a cloud further comprises an AC bias voltage applied to transporting means.

17. In a method for forming images on an image receiving surface with developer, the steps including:
   - providing a supply of developer;
   - transporting developer from said supply to an area adjacent said image receiving surface;
   - forming transported developer into a cloud of marking particles;
   - controlling the spacing of said marking particle cloud relative to said image receiver without touching said image receiving surface, said controlling step being independent of said forming step; and
   - establishing a development field between said transporting means and said image receiving surface for causing an image on said image receiving surface to be developed with marking particles.

18. The method according to claim 17 wherein step of controlling the spacing of said marking particle cloud includes applying an AC bias voltage between a developer transport and said image receiving surface.

19. The method according to claim 18 wherein said step of forming transported developer into a cloud is effected by applying an AC bias to said developer transport.

20. The method according to claim 18 wherein said step of forming transported developer into a cloud is effected by means disposed between said developer transport and said image receiving surface.

21. The method according to claim 20 wherein said means disposed between said developer transport and said image receiving surface comprises an electrode structure.

22. The method according to claim 21 wherein said means disposed between said developer transport and said image receiving surface comprises an AC bias voltage applied to said electrode structure.

23. The method according to claim 22 wherein said AC bias voltages have a different magnitude.

24. The method according to claim 23 wherein the AC bias voltage applied between said image receiving surface and said developer transport is out of phase with the AC bias voltage applied to said electrode structure.

25. The method according to claim 24 including the step of forming tri-level images on said image receiving surface.

26. The method according to claim 25 said tri-level images are formed in a single pass of said image receiving surface past the processing stations used in forming said images.

27. The method according to claim 26 wherein said supply of developer comprises two component developer.

28. The method according to claim 26 wherein said supply of developer comprises single component developer.

29. The method according to claim 28 wherein said developer transport comprises a donor roll.

30. The method according to claim 29 wherein said steps of providing, transporting, forming and controlling comprise steps for developing an image and wherein said method of forming images further includes another method including another supply of developer for developing an image.

31. The method according to claim 30 wherein said tri-level images comprise two images areas and a background area.

32. The method according to claim 31 wherein said developer supply is utilized for developing one of said two images and said another of said developer supplies is utilized for developing the other of said two images.

* * * * *